United States Patent [19]

Gray et al.

[11] 3,974,942

[45] Aug. 17, 1976

[54] POUCHED OIL DISPENSER

[75] Inventors: Peter Harrison Gray; Grant David Row, both of Kingston; John David Stinson, Napanee, all of Canada

[73] Assignee: Du Pont of Canada Limited, Montreal, Canada

[22] Filed: Oct. 11, 1974

[21] Appl. No.: 514,257

[30] Foreign Application Priority Data

Apr. 30, 1974 Canada ..... 198577

[52] U.S. Cl. ..... 222/83.5; 222/86; 222/88

[51] Int. Cl.[2] ..... B67B 7/26

[58] Field of Search ..... 222/83–86, 222/88, 81, 82

[56] References Cited

UNITED STATES PATENTS

| | | | |
|---|---|---|---|
| 1,631,542 | 6/1927 | Manuel | 222/86 |
| 2,179,390 | 11/1939 | Urton | 222/83.5 |
| 2,339,895 | 1/1944 | Waters et al. | 222/83.5 X |
| 2,442,126 | 5/1948 | Halstead | 222/81 |
| 2,486,245 | 10/1949 | Bates | 222/83.5 |
| 2,659,517 | 11/1953 | Reinhardt, Jr. | 222/83.5 X |
| 2,700,972 | 2/1955 | Haden | 222/82 X |
| 2,788,917 | 4/1957 | Cool | 222/83.5 |
| 2,815,885 | 12/1957 | Haas | 222/82 |

*Primary Examiner*—Robert B. Reeves
*Assistant Examiner*—Charles A. Marmor

[57] ABSTRACT

An apparatus is disclosed for dispensing a liquid packaged in a thermoplastic film pouch into a receptacle therefor. The apparatus comprises: (a) a funnel portion terminating at its outlet end in a spout, the spout being adapted to fit into an opening in the receptacle, (b) a pouch receiving portion integrally joined to the funnel portion at its inlet end and forming an extension of at least one side thereof, (c) a pouch support in the pouch receiving portion, the pouch support extending into the funnel portion and being adapted to support on its upper surface a pouch of liquid such that an ear thereof projects over the pouch support into the funnel portion, (d) cutting blades movably positioned beneath the end of the pouch support extending into the funnel, the cutting blades being adapted to be moved from their position beneath the end of the pouch support to a position further into the funnel portion so as to cut open the ear of the pouch, and (e) a coil spring connected to the cutting blades adapted to automatically return the cutting blades to their position beneath the end of the pouch support. The apparatus is useful for purposes such as: (1) dispensing motor oil into the crankcases of motor vehicles; (2) dispensing ethylene glycol antifreeze into the radiators of motor vehicles; and (3) dispensing windshield washer antifreeze and brake fluid into the respective containers therefor on motor vehicles.

7 Claims, 3 Drawing Figures

POUCHED OIL DISPENSER

The present invention relates to apparatus for dispensing liquids packaged in thermoplastic film pouches and more particularly to apparatus for the dispensing of, for example, motor oil packaged in thermoplastic film pouches into the crankcase of motor vehicles.

The packaging of motor oil in thermoplastic film pouches is known in the art. R. E. Pederson in Canadian Pat. No. 921,819, which issued Feb. 27, 1973, describes such packaging i.e. the packaging of motor oil on a "form and fill machine" using a web of a laminated structure comprising a layer of polyamide film laminated between two layers of low density polyethylene film. It is more economical to package motor oil in these thermoplastic film pouches than it is to package it in either the one quart or the one gallon rigid containers referred to hereinafter as "cans" in which it has been customarily delivered to the user. The acceptance of these thermoplastic film pouches filled with motor oil by the users i.e. the service station operators has been delayed because heretofore no satisfactory apparatus have been found to dispense the pouched oil into the crankcases of motor vehicles.

Many attempts have been made to design and fabricate apparatus to position and pierce an oil containing pouch so that the oil may be dispensed into the crankcase of a motor vehicle with the same characteristics of cleanliness, convenience, reliability and safety as is achieved with the specially designed piercing and pouring spout used for oil cans. These attempts have been unsuccessful usually because the apparatus known heretofor have lacked at least one of the four characteristics mentioned above.

In each of these known apparatus (or dispensers), the pouch is pierced by either sharp blades or a spear that create some hydraulic pressure within the pouch during entry. This pressure results in oil splash within the dispenser which leads to contamination with oil of the next pouch placed in the dispenser, of the hands and clothes of the attendant servicing an automobile, and of the automobile being serviced. Additional inconvenience may arise because in some of these dispensers there exists a need for accurate positioning of the pouch before it is pierced. In other dispensers the cutting blades or spear for piercing the pouch may create a hazard either because of the position or because of the manner of operation thereof.

It is therefore an objective of the present invention to provide an apparatus for dispensing a liquid e.g. motor oil packaged in a thermoplastic film pouch into a receptacle therefor e.g. the crankcase of the motor vehicle, in which a cutting means is positioned such that when activated it produces a patterned cut in an ear of the pouch without creating any appreciable internal pressure in the pouch and such that the oil flows from the patterned cut at a predetermined acceptable flow rate directly and exclusively into a funnel or spout portion of the apparatus.

It is another objective of the present invention to provide such an apparatus in which the pouch may be easily placed with an ear thereof positioned so as to receive the patterned cut when the cutting means is activated.

It is a further objective of the present invention to provide such an apparatus which may be removed from the receptacle and inverted (spout up to prevent spout drips) without liquid flowing into the pouch receiving portion of the apparatus.

It is a still further objective of the present invention to provide such an apparatus in which the cutting means is fully shielded when not being activated.

With these and further objectives in view the present invention accordingly provides an apparatus for dispensing a liquid packaged in a thermoplastic film pouch into a receptacle therefor comprising:

a. a funnel portion terminating at its outlet end in a spout, the spout being adapted to fit into an opening in the receptacle.

b. a pouch receiving portion integrally joined to the funnel portion at its inlet end and forming an extension of at least one side thereof.

c. a pouch support in the pouch receiving portion the pouch support extending into the funnel portion and being adapted to support on its upper surface a pouch of liquid such that an ear thereof projects over the pouch support into the funnel portion.

d. cutting means movably positioned beneath the end of the pouch support extending into the funnel portion, the cutting means being adapted to be moved from its position beneath the end of the pouch support to a position further into the funnel portion so as to cut open the ear of the pouch, and e. spring means for said cutting means adapted to automatically return the cutting means to its position beneath the end of the pouch support.

In an embodiment of the present invention the apparatus includes a lip around the inner circumference of the funnel portion beyond the end of the pouch support, the lip being integrally joined along its outer edge to the funnel portion and sloping inwardly therefrom towards the spout to its other edge, the lip being adapted to prevent liquid from the spout entering the pouch receiving portion when the apparatus is removed from the opening in the receptacle and inverted.

In another embodiment the cutting means comprises at least two knife blades mounted in a spaced relationship in a face of a knife support.

In a further embodiment the apparatus includes guide means attached to the knife support adapted to bring the ear of the pouch into position to be cut by the knife blades.

In yet another embodiment the guide means is the face of the knife support in which the knife blades are mounted, the face of the knife support sloping towards the spout at an angle of from about 30° to about 45° to the upper surface of the pouch support.

In a still further embodiment the pouch support is adjustably mounted.

The present invention may be illustrated more fully by the following description taken in conjunction with the accompanying drawings in which.

Figure 1:
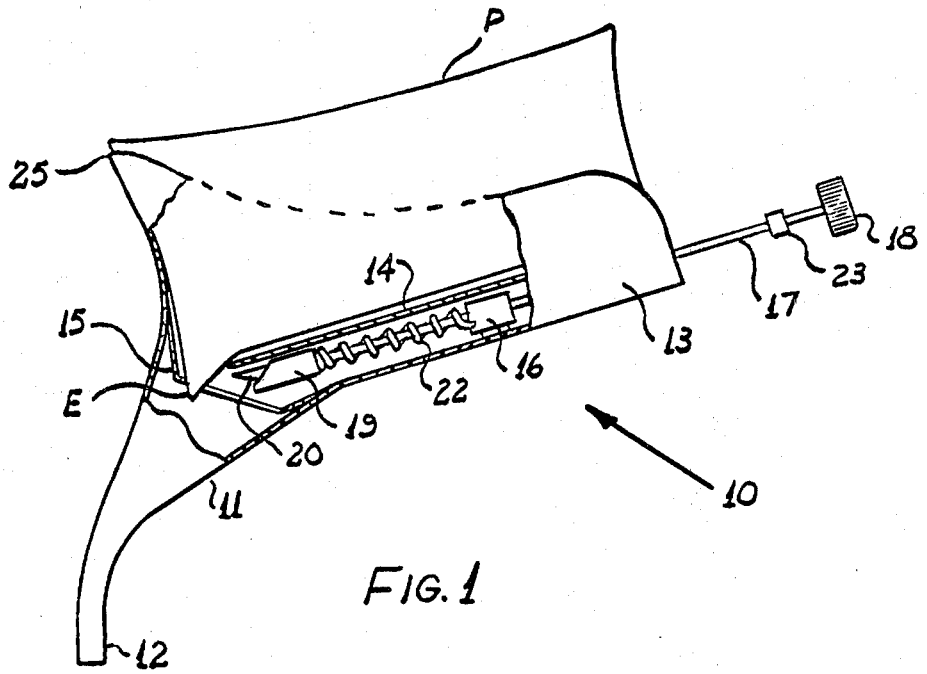
FIG. 1 is a schematic representation (partially in section) of an embodiment of the apparatus of the present invention showing a motor oil-filled pouch in the apparatus.

Referring now to FIG. 1, an apparatus for dispensing motor oil packaged in a thermoplastic pouch into a crankcase of a motor vehicle is designated generally by the numeral 10. Apparatus 10 comprises a funnel portion 11 which terminates at its outlet end in a spout 12. A pouch receiving portion 13 is integrally joined to the funnel portion 11 at the inlet end of the funnel portion 11 to form an extension thereof. As shown in the cutaway portion of FIG. 1, a pouch support 14 covers the bottom of the pouch receiving portion 13 and extends into the funnel portion 11. Pouch support 14 supports an oil-filled pouch P such that the ear E of the pouch P projects over the funnel end of the pouch support 14 into the funnel portion 11. A lip 15 is provided around the inner circumference of the funnel portion 11. Lip 15 is integrally joined along its outer edge to the funnel portion 11 and slopes inwardly therefrom towards the spout 12 to its other edge.

Figure 2:
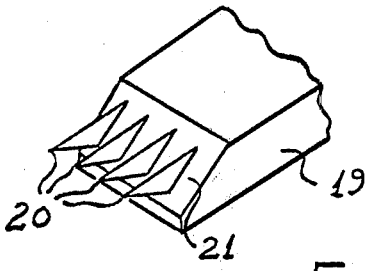
FIG. 2 is an enlarged view of a part of the apparatus shown in FIG. 1.

A guide 16 supports for reciprocating movement a plunger arm 17 which extends the length of the pouch receiving portion 13 from the funnel end and protrudes from the other end thereof. A knob 18 is attached on the protruding end of the plunger and a knife support 19 is attached on the funnel end. Knife blades 20 (see FIG. 2) are mounted in the face 21 of knife support 19. A coil spring 22 housing a portion of plunger arm 17 is connected at one of its ends to the knife support 19 and is connected at its other end to guide 16. A plunger stop 23 is mounted on plunger arm 17 near knob 18.

Face 21 of knife support 19 slopes downwardly towards the spout 12 at an angle of from about 30° to about 45° to the plane of pouch support 14. In each of knife blades 20, the upper edge of the blade is unsharpened and is substantially parallel to the pouch support 14. The lower edge of each of knife blades 20 is the cutting edge and slopes downwardly from the upper edge and away from the funnel at an angle of from about 30° to about 45°.

Figure 3:
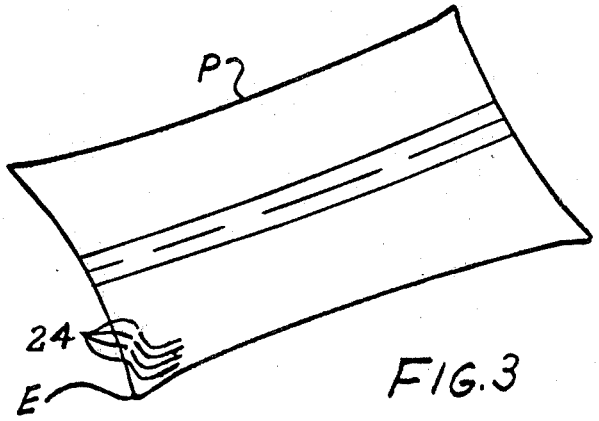
FIG. 3 is a schematic representation of an empty pouch showing the shape of the cuts made in an ear of the pouch by the apparatus of FIG. 1.

To use the apparatus of FIG. 1, the spout 12 thereof is inserted into the oil filling tube for the crankcase of a motor vehicle. A pouch of motor oil P is dropped into the pouch receiving portion 13 where it is supported by pouch support 14 such that an ear E of the pouch P projects over the pouch support 14 into the funnel portion 11. It is desirable that the front face of pouch receiving portion 13 be long enough to support the upper ear of pouch of oil P i.e. to prevent it from flopping over the top 25 of the front face to form a pocket of oil. Pressure is then applied to knob 18 to move plunger arm 17 through guide 16 until plunger stop 23 contacts the upper end of pouch receiving portion 13. As plunger arm 17 moves through guide 16 the knife blades 20 move out from under pouch support 14 and penetrate the side surface of ear E of pouch P. The knife blades 20 continue to penetrate until the side surface of ear E contacts face 21 of knife support 19. Then, face 21 guides the side surface of ear E as the knife blades 20 cut four parallel slits therein. When the knife blades 20 reach the point where the side surface of ear E joins the end surface of ear E, the blades cut four slits in the end surface of ear E and then exit the pouch. Plunger stop 23 prevents the knife blades 20 from contacting the wall of funnel portion 11. Coil spring 22 pulls knife support 19 back to its position under pouch support 14 (as indicated in FIG. 1) as soon as the pressure is released from knob 18. The shape of the curved slits produced by the knife blades 20 in the ear E of pouch P is indicated in FIG. 3 by the numeral 24.

As soon as the curved slits 24 are produced in the ear E of pouch P, the ear E opens up along the slits 24 and discharges the oil from the pouch P into the spout 12 in a period of about 10 to 20 seconds for a one imperial quart package of oil. As the oil drains from the pouch P it tends to collapse due to atmospheric pressure. When substantially all of the oil has drained from the pouch P, air enters through slits 24 and tends to inflate the pouch P thus giving a good indication of when it is empty. The empty pouch is then removed from the apparatus 10. The apparatus 10 is removed from the oil filling tube for the crankcase of the motor vehicle, inverted to prevent drips from spout 12 and is then placed spout 12 down in a drip can to allow the spout 12 to drain. When the apparatus 10 is removed from the oil filling tube and inverted, lip 15 prevents oil in the spout 12 from entering the pouch receiving portion 13 of the apparatus 10.

Pouch support 14 may be adjustably mounted to allow the rate of flow of oil or other liquid from the dispenser to be varied. e.g. if the pouch support 14 is moved further into the funnel portion 11, the length of ear E which projects over the pouch support is shortened and hence the length of the slits made by knife blades 20 is also shortened and the rate of flow of liquid from the dispenser 10 is reduced.

Cutting means other than the knife blades 20 mounted in face 21 of knife support 19 may be employed in the apparatus of the present invention. It is important, however, that such cutting means produce at least two closely spaced curved slits in the ear E of the pouch P e.g. at least two slits along the side surface and into the end surface of ear E. If only straight slits are cut in the ear E of the pouch P by the cutting means, the slits may not open sufficiently to allow the oil to drain in a reasonable time and/or the slits may close up again before the pouch is empty resulting in incomplete dispensing of the oil.

It will be appreciated that guide means other than face 21 of knife support 19 may be provided to bring the side surface of ear E into position to be cut by knife blades 20 e.g. a guide finger or guide fingers extending from knife support 19.

While the apparatus of the present invention has been described hereinbefore with reference to the dispensing of motor oil the apparatus may be used to dispense various other liquids packaged in thermoplastic film pouches and especially to dispense ethylene glycol antifreeze into the radiators of motor vehicles and to dispense windshield washer antifreeze and brake fluid into the respective containers therefor on motor vehicles.

The present invention is illustrated by the following example.

EXAMPLE

Several imperial quart (1136 ml.) pouches of motor oil were dispensed from each of three dispensers. The dispensers were as described hereinbefore and indicated in FIGS. 1 and 2 of the drawings except that their knife supports carried two, four and six knife blades respectively.

The results of the above test are summarized in the Table below.

TABLE

| Dispenser No. | No. of Knife Blades | Test No. | Time* (seconds) | Oil Remaining in Pouch ml.** |
|---|---|---|---|---|
| 1 | 2 | 1 | 11 | 20 |
| | | 2 | 13.5 | 10 |
| | | 3 | 13 | 25 |

TABLE-continued

| Dispenser No. | No. of Knife Blades | Test No. | Time* (seconds) | Oil Remaining in Pouch ml.** |
|---|---|---|---|---|
| | | 4 | 16 | 25 |
| 2 | 4 | 1 | 12 | 20 |
| | | 2 | 16 | 10 |
| | | 3 | 20 | 20 |
| | | 4 | 20 | 10 |
| 3 | 6 | 1 | 8 | 15 |
| | | 2 | 9 | 25 |
| | | 3 | 10 | 20 |
| | | 4 | 12 | 20 |

*Timing was stopped when the pouch had become inflated with air entering through the slits.

**Measured by allowing the oil to drip out of pouch into a measuring cylinder for an additional five minutes.

The rate of oil flow obtained in the first two tests with dispenser No. 3 which had six knife blades is higher than can be handled by the filling tubes of some motor vehicles.

some of the differences in operating characteristics among the above three dispensers may be due to the fact that these dispensers were not precision made.

We claim:

1. An apparatus for dispensing a liquid packaged in a thermoplastic film pouch having ears into a receptacle therefor comprising:

a. a funnel portion having an inlet end and an outlet end and terminating at said outlet end in a spout, said spout being adapted to fit into an opening in said receptacle, b. a pouch receiving portion integrally joined to said funnel portion at said inlet end and forming an extension thereof, said pouch receiving portion including a bottom, c. a pouch support having a funnel end in and covering said bottom of said pouch receiving portion and extending into said funnel portion in a manner to support on its upper surface said pouch such that one of said ears projects over said funnel end of said pouch support into said funnel portion, d. at least two knife blades mounted in a spaced relationship in a face of a knife support and positioned beneath said pouch support, said knife blades being movable from said position beneath said pouch support to a position in said funnel portion so as to cut open said one of said ears of said pouch, said knife support being attached to one end of a plunger arm, said plunger arm extending the length of said pouch receiving portion and protruding therefrom at its other end, said plunger arm being supported for reciprocal movement by a guide, and e. a coil spring housing a portion of said plunger arm and connected at one of its ends to said knife support and at the other of its ends to said guide for returning said knife blades to said position beneath said pouch support.

2. The apparatus of claim 1 including a lip around the inner circumference of said funnel portion beyond said funnel end of said pouch support, said lip being integrally joined along its outer edge to said funnel portion and sloping inwardly therefrom towards said spout to its other edge whereby liquid from said spout is prevented from entering said pouch receiving portion when said apparatus is removed from said opening in said receptacle and inverted.

3. The apparatus of claim 1 including guide means attached to said knife support adapted to bring said one of said ears of said pouch into position to be cut by said knife blades.

4. The apparatus of claim 3 in which said guide means is said face of said knife support in which said knife blades are mounted.

5. The apparatus of claim 4 wherein said face of said knife support in which said knife blades are mounted slopes towards said spout at angle of from about 30° to about 45° to said upper surface of said pouch support.

6. The apparatus of claim 5 in which said knife blades are mounted substantially in parallel at the same level in said face of said knife support.

7. The apparatus of claim 6 in which each of said knife blades has an upper edge and a lower edge meeting at a point, said upper edge being unsharpened and substantially parallel to the upper surface of said pouch support, the lower edge being a cutting edge and sloping downwardly and rearwardly from said upper edge at an angle of from about 30° to about 45° thereto.

* * * * *